US005373861A

United States Patent [19]

Eaton

[11] Patent Number: 5,373,861

[45] Date of Patent: Dec. 20, 1994

[54] SYSTEM AND METHOD FOR CASING TOBACCO

[76] Inventor: Jay S. Eaton, Rte. 2, Buladean, Bakersville, N.C. 28705

[21] Appl. No.: 953,084

[22] Filed: Sep. 29, 1992

[51] Int. Cl.[5] ..... A24B 3/00

[52] U.S. Cl. ..... 131/303; 131/304

[58] Field of Search ..... 131/303, 304, 306, 300, 131/302

[56] References Cited

U.S. PATENT DOCUMENTS

| | | | |
|---|---|---|---|
| 715,185 | 12/1902 | Warner . | |
| 951,650 | 3/1910 | Miller | 131/304 |
| 2,777,446 | 1/1957 | Bogaty . | |
| 2,904,193 | 9/1959 | Poythress . | |
| 3,425,158 | 2/1969 | Kyle . | |
| 3,580,386 | 5/1971 | Arnould . | |
| 3,999,303 | 12/1976 | Martin et al. . | |
| 4,064,648 | 12/1977 | Cary . | |
| 4,068,405 | 1/1978 | Campbell et al. . | |
| 4,664,131 | 5/1987 | Moorefield, II . | |
| 5,050,318 | 9/1991 | Du Bruyn . | |

*Primary Examiner*—William H. Grieb
*Attorney, Agent, or Firm*—Dority & Manning

[57] ABSTRACT

A continuous casing system is provided for bringing air dried tobacco in case. The system includes a greenhouse structure and at least one casing bay defined within the greenhouse. The casing bay is defined by appropriate structural members which are spaced apart a predetermined distance generally equal to the length of tobacco rods from which the tobacco is hung. Means are provided within the greenhouse structure for maintaining a predetermined relative humidity within the greenhouse, preferably around 90 percent humidity. A system for variably conveying the tobacco rods through the casing bay along the support structure in a substantially continuous manner is also provided whereby the tobacco rods with tobacco stalks hanging therefrom can be placed upon the support structure at one end of the casing bay and conveyed therethrough at a predetermined rate so that the tobacco is brought in case before being unloaded at the opposite end of the casing bay.

14 Claims, 7 Drawing Sheets

SYSTEM AND METHOD FOR CASING TOBACCO

BACKGROUND OF THE INVENTION

The present invention relates to a method and system for casing air dried tobacco, and more particularly to an apparatus and method for conveying air dried tobacco through a relative humidity controlled structure for bringing the tobacco in case in a controlled environment.

One form of commercially grown tobacco is commonly known as air dried tobacco. Air dried tobacco is cured or dried generally by hanging the tobacco (tobacco stalks) in curing sheds or structures. Burley tobacco is a common example of such air dried tobacco.

Burley tobacco plants grow as relatively tall stalks with the tobacco leaves growing radially out from the stalks. Typically, when the burley tobacco stalks are cut, the widest portion (bottom of the stalk) of the main stem is manually skewered onto a stake or rod. Generally, the rods are about five or six feet long and about five or six different stalks are threaded onto each stake. After the threading process, the stakes are transported to a curing shed or barn for curing or drying the tobacco. A portable curing cell for drying or curing this type of tobacco is described in my co-pending U.S. application Ser. No. 850,410.

Once the tobacco is properly cured or dried, it must be brought in case for further processing for market. The dried tobacco cannot be adequately handled otherwise since the dried leaves are quite fragile and brittle and tend to break apart at the slightest touch. Casing tobacco requires that the cured tobacco be brought to a predetermined relative moisture content, preferably at least 14 percent moisture content for processing for market. Various ways are known to case the tobacco but, these ways are inadequate for a generally high volume continuous harvesting and processing system.

For example, in the case of cured burley tobacco, one method of casing tobacco involves essentially laying the tobacco stalks in a pile, spraying water onto the stalks and subsequently covering the pile with tarpaulins. This method has proved problematic in that it is generally impossible to obtain a uniform relative humidity content within the tobacco throughout the pile. In other words, the leaves sprayed with water tend to be overly soaked while the inner leaves tends to remain dry. Also, the tarp tends to retain excessive heat and the tobacco which has not been adequately sprayed will dry out excessively under the tarp instead of being brought to a proper humidity condition.

Additionally, tobacco farmers harvesting air dried tobacco tend to be at the mercy of the elements as far as casing the tobacco is concerned. Typically, the farmers will pull the cured tobacco from the curing sheds early in the morning when the conditions are relatively humid. Foggy mornings are the optimum condition. If the conditions are proper, the tobacco will have an adequate degree of moisture content so that the workers can handle the tobacco for processing. However, once the relative humidity in the air decreases as the day heats up, the farmers can no longer process the cured tobacco and must wait for the next morning or otherwise adequate weather conditions.

Thus, what is needed is a system and method for continuously casing tobacco so that the modern tobacco farmer can operate and sustain a relatively large volume and continuous harvesting and processing system.

Controlled growing environments for plants are known, but do not address the needs of the air dried tobacco farmer. For example, U.S. Pat. No. 4,068,405 discloses an apparatus and method for establishing and maintaining a controlled environment for the growth of food yielding plants and includes a number of multiple layer continuous chain drive systems each supporting an array of plant trays. U.S. Pat. No. 4,064,648 discloses a greenhouse insulating system for reducing heat loss from the structure. Systems are also know for conditioning cut tobacco, such as U.S. Pat. No. 2,777,446 which discloses a system and apparatus for cooling and bulking cut tobacco. This system, however, pertains to bulking and processing a type tobacco which has already been cut, dried, and brought to a predetermined relative moisture content. This method pertains to flue dried tobacco, which is harvested in leaves, and does not address the problems faced by the air dried tobacco farmers, particularly the burley tobacco farmers. U.S. Pat. No. 5,050,318 discloses a dryer racking system for drying produce in a barn and includes an endless conveyor to which are attached a plurality of containment devices which can be packed with produce such as tobacco leaves. This system also does not address the problems of adequately curing air dried or cured tobacco.

OBJECTS AND SUMMARY OF THE INVENTION

It is a principle object of the present invention to provide a system and apparatus for continuously casing air dried tobacco.

A further object of the present invention is to provide a casing system wherein a continuous and relatively large volume of tobacco can be brought in case.

Still a further of this invention is to provide an efficient and labor saving method for casing air dried tobacco which is not dependent on outside weather conditions or time of day.

Yet a further object of the present invention is to provide a casing system for processing a relatively large volume of cured tobacco in a relatively short period of time.

And still a further object of the present invention is to provide an air dried tobacco casing system and method for achieving a uniform and optimum moisture content in the tobacco in a continuous automated fashion.

Additional objects and advantages of the invention will be set forth in part in the description which follows, and in part will be obvious from the description or may be learned by practice of the invention. The objects and advantages of the invention may be realized and obtained by means of the instrumentalities and combinations particularly pointed out in the appended claims. To achieve the objects and in accordance with the purpose of the invention, as embodied and broadly described herein, a continuous casing system for bringing tobacco in case is provided, the tobacco being in the form of air dried cut tobacco stalks hung from tobacco rods or similar devices. The system comprises a greenhouse structure and at least one casing bay defined within the greenhouse structure. The casing bay is preferably defined by at least two rows of generally upright support poles, the support poles being substantially parallel and spaced apart a predetermined distance of generally the length of the tobacco rods. A tobacco rod support member is provided and carried by each row of support poles, whereby at least two support members are oppositely facing within each casing bay. The support members are at a height so that stalk laden tobacco rods can be suspended therefrom across the casing bays with adequate ground clearance so that the tobacco stalks do not touch the ground or floor of the greenhouse. Means are also provided for maintaining a predetermined relative humidity within the greenhouse structure, such as conventional fogging devices or other atmospheric control equipment. Means are also provided for variably conveying the tobacco rods through the casing bay along the support members in a substantially continuous and controlled manner. In this way, the tobacco rods with tobacco stalks hanging therefrom can be placed upon the support members at one end of the casing bay and be conveyed therethrough at a predetermined rate so that the tobacco is brought in case before being unloaded at the opposite end of the casing bay.

In one preferred embodiment of the system a plurality of casing bays are defined within the greenhouse structure so that multiple loads of tobacco can be processed simultaneously within the greenhouse structure.

Preferably, the greenhouse structure comprises selectably raisable side panels or walls so that the climate conditions within the structure can be varied by raising and lowering the side panels.

Preferably, the conveying means according to the invention includes a chain drive apparatus which further includes at least one driven sprocket, variable driving means for driving the driven sprocket, at least one continuous conveying member (such as a mill chain) extending along at least one of the support members within the casing bay, and positioning means affixed to the conveying member or chain for maintaining tobacco rods at predetermined positions along the continuous conveying member.

In still another preferred embodiment, the greenhouse structure is generally portable and comprises interconnectable framework members and relatively flexible sheeting material fitted upon the framework members forming the roof and sides of the greenhouse structure. Preferably, means are provided for variably adjusting the height of the sheeting material forming the sides of the greenhouse structure so that at least a portion of the sides of the structure can be opened to the outside. In a preferred embodiment, the means for variably adjusting the height of the sheeting material is mechanized and automated so that the sides will open and close at a predetermined condition within the greenhouse.

In the preferred embodiment of the invention, the conveying means are configured to convey the tobacco in one pass through the casing bay at such a rate so that the tobacco is encased by the time it reaches the opposite end of the casing bay. However, in another preferred embodiment, the conveying means may be configured to convey the tobacco rods in multiple passes through the greenhouse. In any event, the rate of conveyance of the tobacco rods through the casing bays is a function of the relative humidity maintained within the greenhouse structure.

And in yet still another preferred embodiment of the invention, the conveying system includes a transportable elevating scaffold trailer. This scaffold trailer is used to transport the tobacco laden rods into the greenhouse structure between the tobacco rod supporting means. In this manner, the scaffold trailer can be lowered between the supporting means and the tobacco rods thereby transferred to the supporting means as the scaffold trailer is lowered below the supporting means. The scaffold trailer is preferred in that a relatively large number of tobacco rods can be simultaneously transferred to the supporting means within the greenhouse structure.

In further accordance with the invention, a method is provided for continuously casing tobacco, the tobacco having been previously hung from tobacco rods and cured. The method comprises the steps of, at one end of a greenhouse structure, placing tobacco laden tobacco rods across support members erected within the greenhouse. The method includes maintaining an optimum climatic condition for casing tobacco within the greenhouse structure with automatic atmosphere control equipment, such as conventional foggers. A rate is determined for conveying the tobacco through the greenhouse structure so that the tobacco is in case by the time it reaches the opposite end of the greenhouse, the rate being a function of the climatic conditions maintained within the greenhouse structure. The method further includes the step of continuously conveying the tobacco laden tobacco rods through the greenhouse structure at the determined rate and retrieving the tobacco rods at the opposite end of the greenhouse structure with the tobacco thereby being in case. Preferably, the method further includes the step of placing the tobacco rods upon an elevating scaffold trailer, transporting the trailer into the greenhouse structure at one end thereof between the support members and lowering the trailer to a height below the support members so that the tobacco rods are transferred thereto. The accompanying drawings, which are incorporated in and constitute a part of the specification, illustrate one embodiment of the invention, and together with the description serve to explain the principles of the invention.

BRIEF DESCRIPTION OF THE DRAWINGS

A full and enabling disclosure of the present invention, including the best mode thereof, directed to one of ordinary skill in the art is set forth in the remainder of the specification, which makes reference to the appended figures in which.

Figure 1:
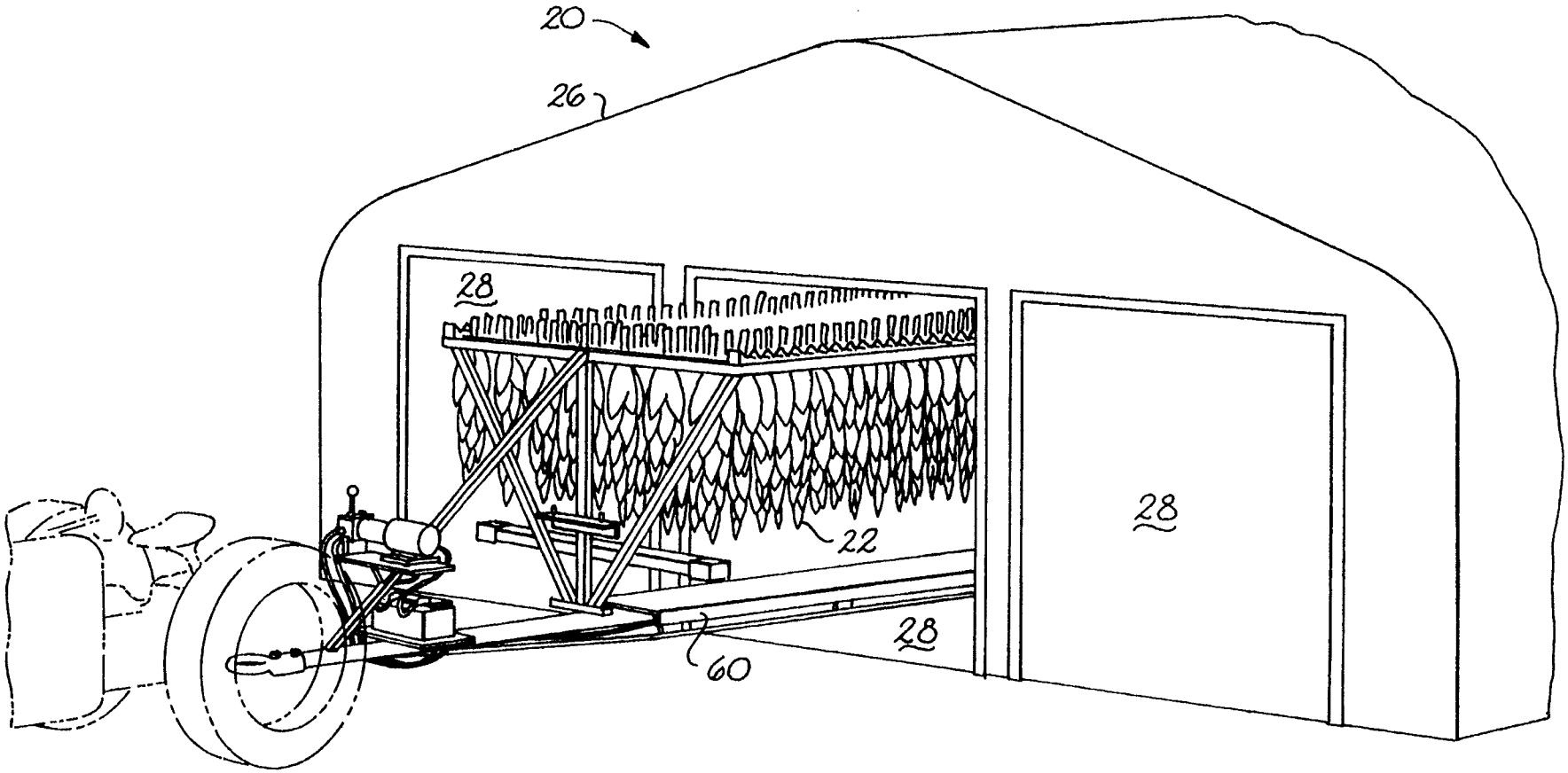
FIG. 1 is a partial perspective illustration of the system according to the present invention particularly illustrating the relation of the scaffold trailer for use therewith.

Repeat use of reference characters in the following specification and appended drawings is intended to represent the same or analogous features, elements, or steps of the present invention.

BRIEF DESCRIPTION OF THE PREFERRED EMBODIMENTS

Reference will now be made in detail to the presently preferred embodiments, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalent.

According to the figures in general, particularly FIGS. 1 through 4, continuous casing system 20 is provided for bringing tobacco 22 in case. Tobacco 22 is of the type described generally in the background section of this application and for clarity sake and ease of explanation, tobacco 22 is depicted as burley tobacco. However, this is not meant as a limitation upon system 20. Tobacco 22 may comprise various types of air dried tobacco.

System 20 includes greenhouse structure 26. Preferably, greenhouse 26 is generally portable in nature and comprises a plurality of interconnectable framework members 48. For example, greenhouse structure 26 may comprise two inch side posts which are approximately four to five feet high and spaced apart four to five feet. Greenhouse structure 26 may include trusses, purlins, and interconnecting bows. These components are preferably prefabricated and pre-fit so that structure 26 may be easily erected at a preselected site. In a preferred embodiment, structure 26 is 30 feet wide with a maximum height of 12 feet along the center thereof with four foot sides. Structure 26 may be in a kit form where all necessary components are included for easy erection and assembly. Greenhouse structure 26 is in no way limited to the portable structure just described but, may include any permanent type of structure such as a barn or warehouse.

Figure 3:
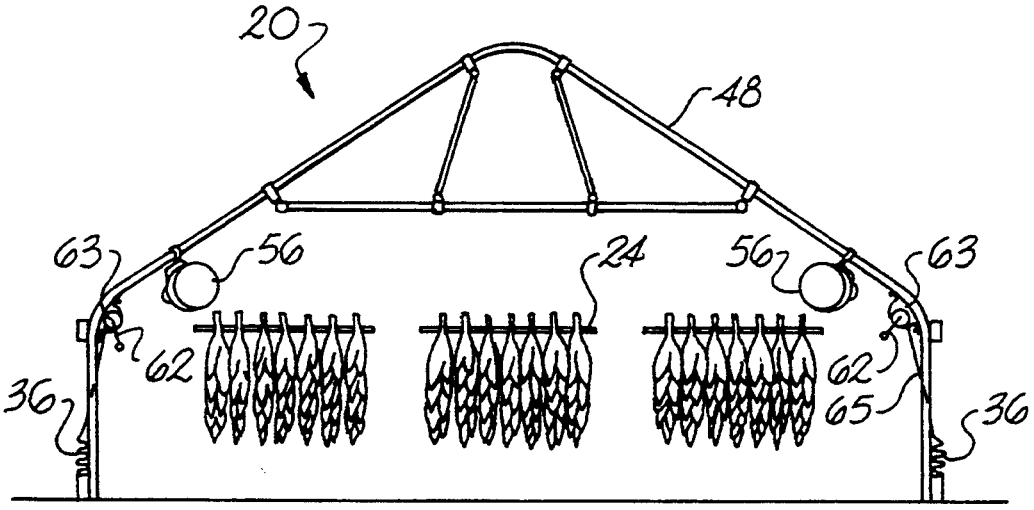
FIG. 3 is a front end partial perspective illustration of the present system and particularly illustrates the structural members of the greenhouse and arrangement of tobacco therein.
Figure 4:
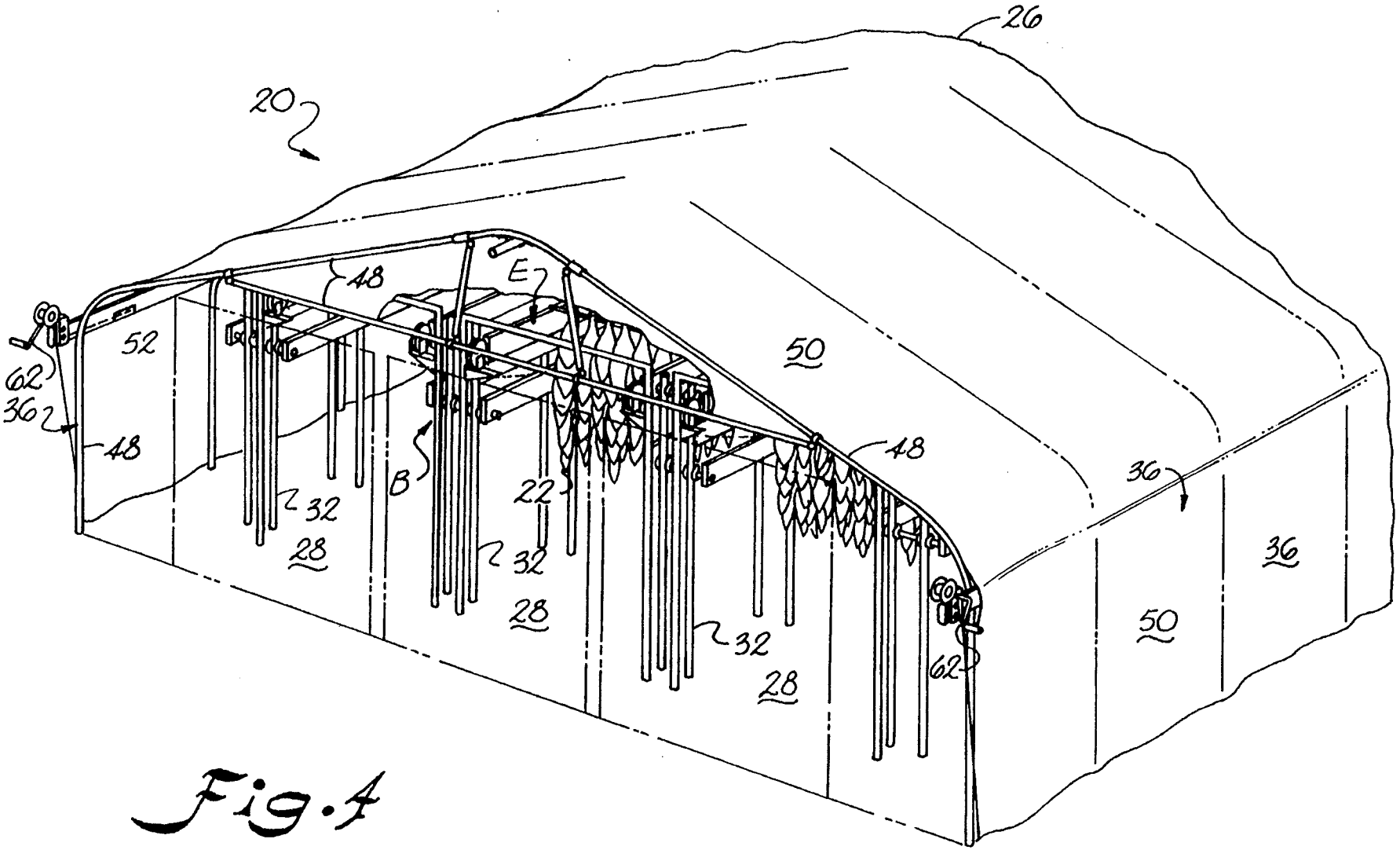
FIG. 4 is yet another perspective illustration of the system of the present invention particularly illustrating the component parts thereof.
Figure 6:
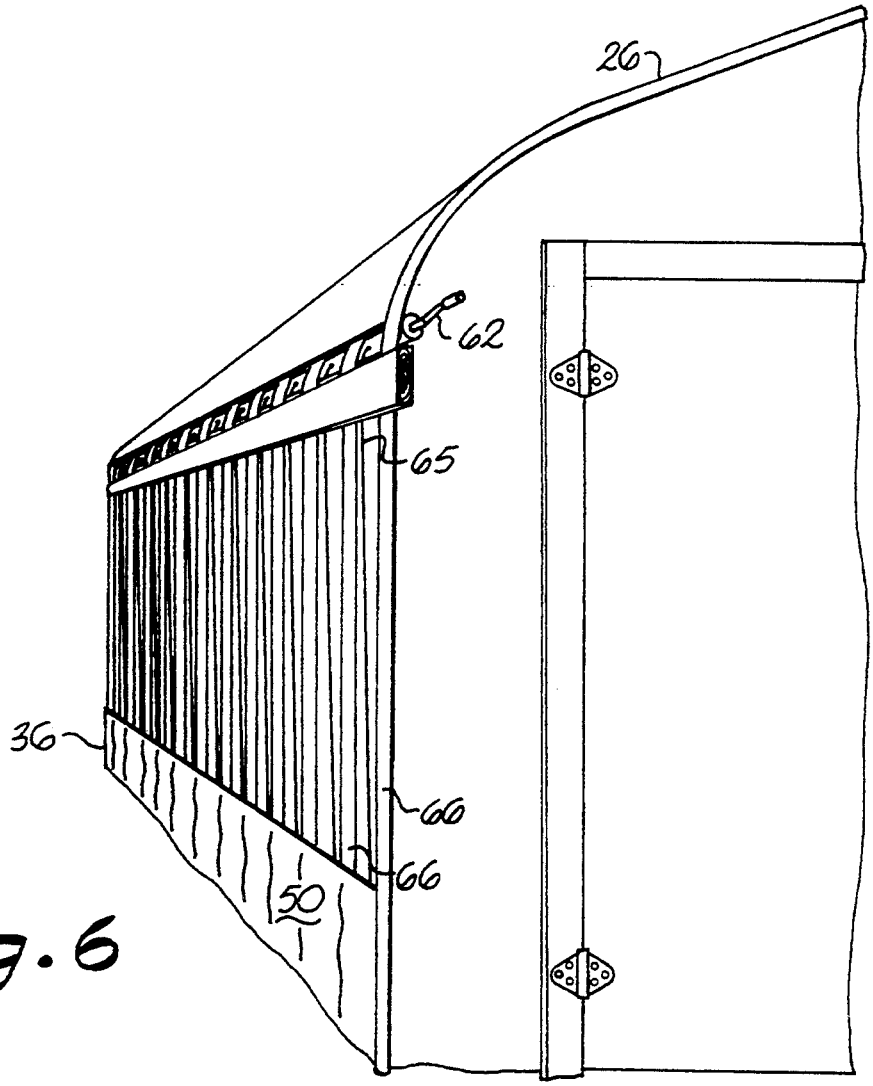
FIG. 6 is a partial perspective view of the system according to the invention particularly illustrating the raisable side panels of the greenhouse structure.

Greenhouse structure 26 also preferably includes selectably raisable side panels 36, illustrated particularly in FIGS. 3, 4, and 6. In this manner, the climatic conditions with greenhouse structure 26 may be varied or changed by simply raising or lowering the side panels of structure 26. In a preferred embodiment illustrated in FIGS. 3 and 6, a windless 62 or other similar mechanism is provided and affixed to purlin or rod 63. Purlin 63 may be attached to structural members 48 by, for example, oversized brackets so as to be able to rotate within the brackets. Cords 65 or like flexible attaching means connect side panels 36 to purlin 63. In this manner, it is relatively simple to raise or lower side panels 63 merely by turning purlin 63 in one direction or the other with windless 63. Although the means for raising and lowering side panels 36 is depicted in the figures generally as a hand windless, it should be understood that any suitable mechanized system may be utilized for raising and lowering panels 36. Preferably, thermostatic device 52 (FIG. 4) is also provided for automatically actuating a mechanized windless 62 to raise and lower side panels 36 upon predetermined conditions being reached within greenhouse structure 26.

An alternative embodiment for raising and lowering side panels 36 is illustrated in FIG. 4. In this embodiment, winch 62 is provided for retrieving or letting out a cable (not shown). Side panels 36 are connected to the cable through cords and pulleys so that side panels 36 can be varied in height according to the direction of travel of the cable.

Greenhouse structure 26 further includes preferably flexible sheeting material 50 which is fitted upon structural members 48 and forms the sides and walls of structure 26. Sheeting material 50 may be, for instance, transparent or semi-transparent polyethylene or like material. In an alternative embodiment, the roof and side panels 36 of structure 26 need not be of the same material. For instance, the roof of structure 26 may comprise generally rigid roofing panels while sides 36 comprise flexible sheeting material 50 or vice versa. Flexible material 50 is preferred for side panels 36 in that it is relatively easy to raise and lower panels 36 by simply rolling or unrolling flexible material 50, as particularly illustrated in FIG. 6. However, this is not meant as a limitation to the system. Although not depicted in the figures, panels 36 may comprise relatively rigid side walls which are appropriately raised and lowered by some mechanized system. Also, the actual mechanized system for rolling and unrolling flexible material 50 of side panels 36 described above is only a preferred embodiment and any suitable system is within the scope and spirit of the present invention. For example, in the embodiment of FIGS. 3 and 6, windless 62 raises and lowers side panels 36 generally from the top thereof. However, in an alternative embodiment, windless 62 may control the raising and lowering of panels 36 by essentially adjusting the side panel from the bottom thereof.

Figure 2:
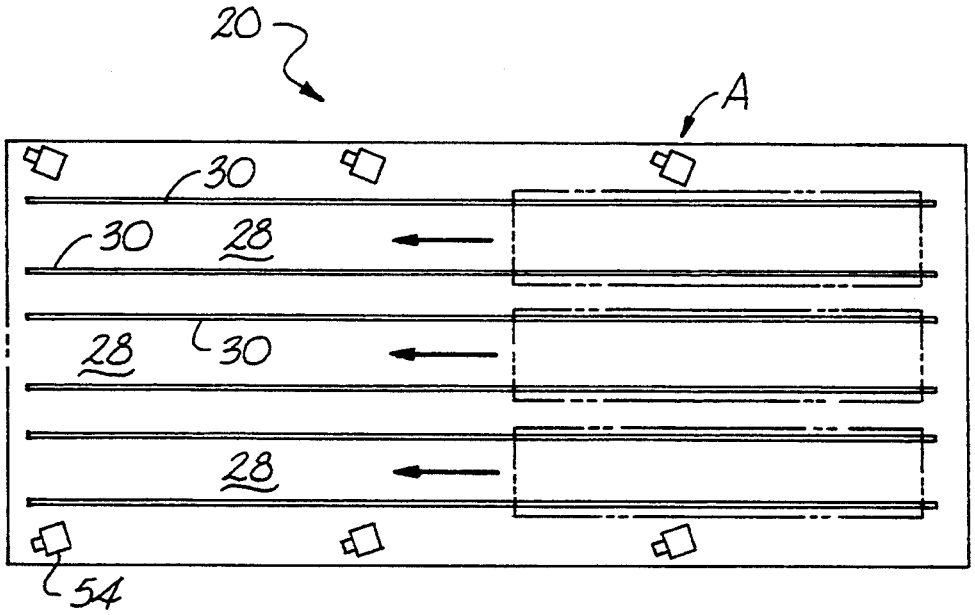
FIG. 2 is a partial diagrammatic component view of the system according to the invention particularly depicting the arrangement of rows of support poles forming a plurality of casing bays within the system.

System 20 further includes at least one casing bay 28, defined within greenhouse structure 26. In a preferred embodiment, casing bay 28 is defined by at least two rows 30 of generally upright support poles 32 as particularly illustrated in FIG. 4 and diagrammatically illustrated in FIG. 2. In a preferred embodiment of the invention, three casing bays 28 are defined within a single greenhouse structure 26, as shown in FIGS. 2 and 4. Rows 30 of support poles 32 are substantially parallel and spaced apart a predetermined distance generally equal to the length of tobacco rods 24 from which tobacco 22 is hung. In other words, casing bays 28 are defined generally between opposite rows 30 of support poles 32.

Figure 5:
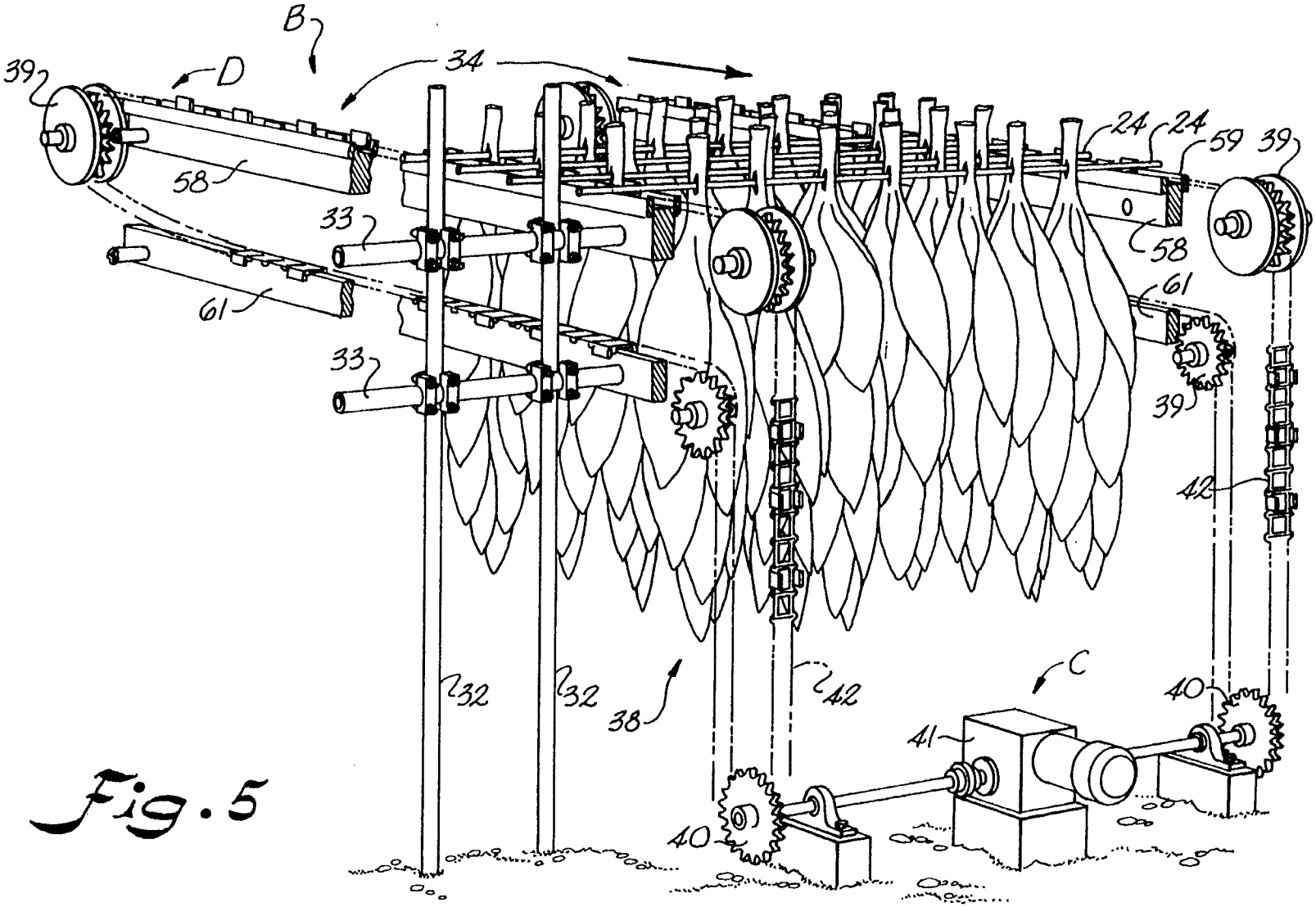
FIG. 5 is a perspective view of the conveying means according to the present invention particularly illustrating an embodiment of the chain drive apparatus and components thereof.

A preferred embodiment of the arrangement of support poles 32 is shown particularly in FIGS. 4 and 5. Support poles 32 may be disposed singularly within rows 30 or, preferably disposed as pairs as illustrated in FIG. 5. In other words, a single row 30 may comprise a series of pairs of support poles 32. It is preferred to use pairs of poles 32 to provide enhanced structural support and ease of construction of system 20. However, it should be understood that a single support pole 32 may suffice, or more than two poles may be arranged in any desired pattern to form rows 30. In the embodiment where a plurality of casing bays 28 are defined within structure 26, pairs of support poles 32, as illustrated in FIG. 5, are preferred in that cross beams 33 may be affixed to an across poles 32 so as to extend into an adjacent bay 28, as illustrated in FIG. 4. In this manner, one row of pairs of support poles 32 can form the left side of one casing bay and the right side of an adjacent casing bay 28.

For ease of construction of system 20 and alignment, poles 32 are preferably positioned in anchor posts or receptacles which have been driven into the ground or floor of structure 26 through a templet or similar device (not shown).

In another preferred embodiment of system 20, casing bays 28 are not necessarily defined by support poles 32 but, may be defined by any structural type members. For instance, bays 28 may be defined by components of structural framework 48 suspended generally from above. In another embodiment, casing bays 28 may be defined by generally solid and rigid walls erected within structure 26.

System 20 according to the invention further includes tobacco rod supporting means E, shown generally in FIG. 4. Tobacco rods supporting means E preferably comprises generally rigid tobacco rod support members 34. Support members 34 may comprise, for instance, rigid beams 58 formed of any suitable material, such as lumber, hard plastic, prefabricated sheet metal, or the like. In the preferred embodiment of the invention, support members 34 are carried by the row of support poles 32 whereby at least two support members 34 are oppositely facing within each casing bay 28, as illustrated particularly in FIG. 4. Support members 34 are attached or otherwise secured to poles 32 at a height so that stalk laden tobacco rods 24 can be suspended therefrom across casing bay 28 with adequate ground clearance for the tobacco stalks. In other words, the rods 22 are hung across casing bays 28 so that the extreme tips of the tobacco stalks do not touch upon the ground. It should be understood that tobacco rod supporting means E need not be separate components which are secured to poles 32 or other members defining casing bays 28 but, may comprise part of the structure actually forming bays 28. For instance, if bays 28 are defined by generally upright walls erected within structure 26, tobacco rods supporting means E may comprise, for instance, the top of such walls.

Tobacco rod supporting means E, or members 34 of the preferred embodiment, are spaced apart a distance so that an elevating scaffold trailer 60 (FIG. 1) may be driven or otherwise transported therebetween. In other words, casing bay 28 is of adequate dimensions so that trailer 60 may be conveyed therethrough. The operation and construction of scaffold trailer 60 is the subject matter of my co-pending U.S. Pat. application 842,231, which is incorporated by reference herein. Generally though, scaffold trailer 60 contains a load or bulk of predetermined number of tobacco rods 24. Trailer 60 is raised to an elevation generally above tobacco rod support members 34 and then driven into casing bay 28. Subsequently, trailer 60 is lowered to a height below support members 34 whereby rods 24 are transferred to support members 34 as trailer 60 lowers below members 34. The general concept of a bulk or load of predetermined number of tobacco laden tobacco rods being conveyed through system 20 is depicted generally in FIG. 2, where three such loads are illustrated being conveyed through three separate casing bays 28 with the tobacco being subjected to atmosphere control equipment A.

Figure 7:
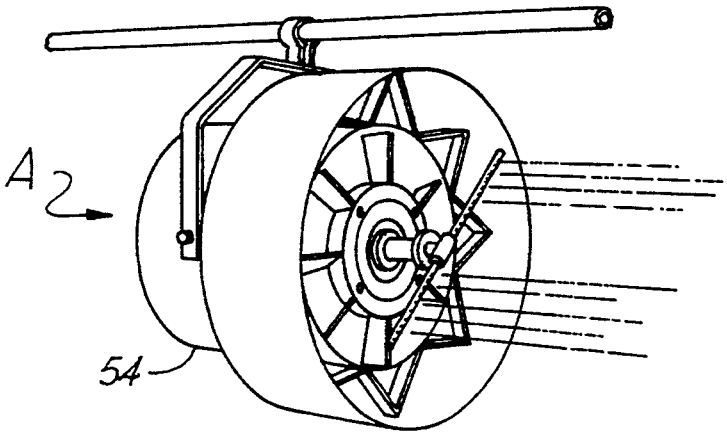
FIG. 7 is a perspective illustration of an embodiment of the atmosphere control equipment according to the invention, particularly illustrating a fogger.

System 20 according to the present invention also comprises means A for maintaining a predetermined relative humidity within greenhouse structure 26. Relative humidity control means A includes atmosphere control equipment 56, which includes at least one fogger 54 depicted in FIG. 7. Atmosphere control equipment 56 is utilized to maintain an optimum relative humidity within the greenhouse, preferably at around 90 percent humidity. A conventional fogger 54 as illustrated in FIG. 7, or any like suitable humidifier or humidifying system, may be utilized as atmosphere control equipment 56. Preferably, fogger 54 is automated so as to cycle on and off at preselected set points to maintain an optimum humidity band within greenhouse 26. Atmosphere control equipment 56 may also include a heating element, recirculating fan, or other conventional equipment for maintaining an optimum climatic condition within the greenhouse. Additionally, as discussed, the condition within the greenhouse can be effected by raising and lowering side panels 36 of structure 26. Preferably, the atmosphere control equipment, particularly foggers 54, are positioned generally near the front or loading end of greenhouse 26 thereby ensuring that the tobacco is properly brought in case before being conveyed the entire length of greenhouse 26.

System 20 also includes variable conveying means B for conveying the tobacco rod 24 through casing bays 28 along the tobacco rod supporting means E, particularly tobacco rod support members 34 as discussed. In a preferred embodiment of the invention, variable conveying means B are depicted generally in FIG. 5. In this embodiment, conveying means B preferably comprises a chain drive apparatus 38. Apparatus 38 includes variable speed driving means C, such as a variable speed electric motor 41 or other suitable driving means. For example, a hydraulic or pneumatic driving motor may also be utilized as variable speed driving means C. Driving means C, or motor 41, drives at least one driven sprocket 40. At least one other idle sprocket 39 is provided so as to form a complete loop with the driven sprocket. It should be understood that any combination of driven and idle sprockets may be utilized to form chain drive apparatus 38. The arrangement depicted in FIG. 5 is but one illustration of an acceptable embodiment.

Figure 8:
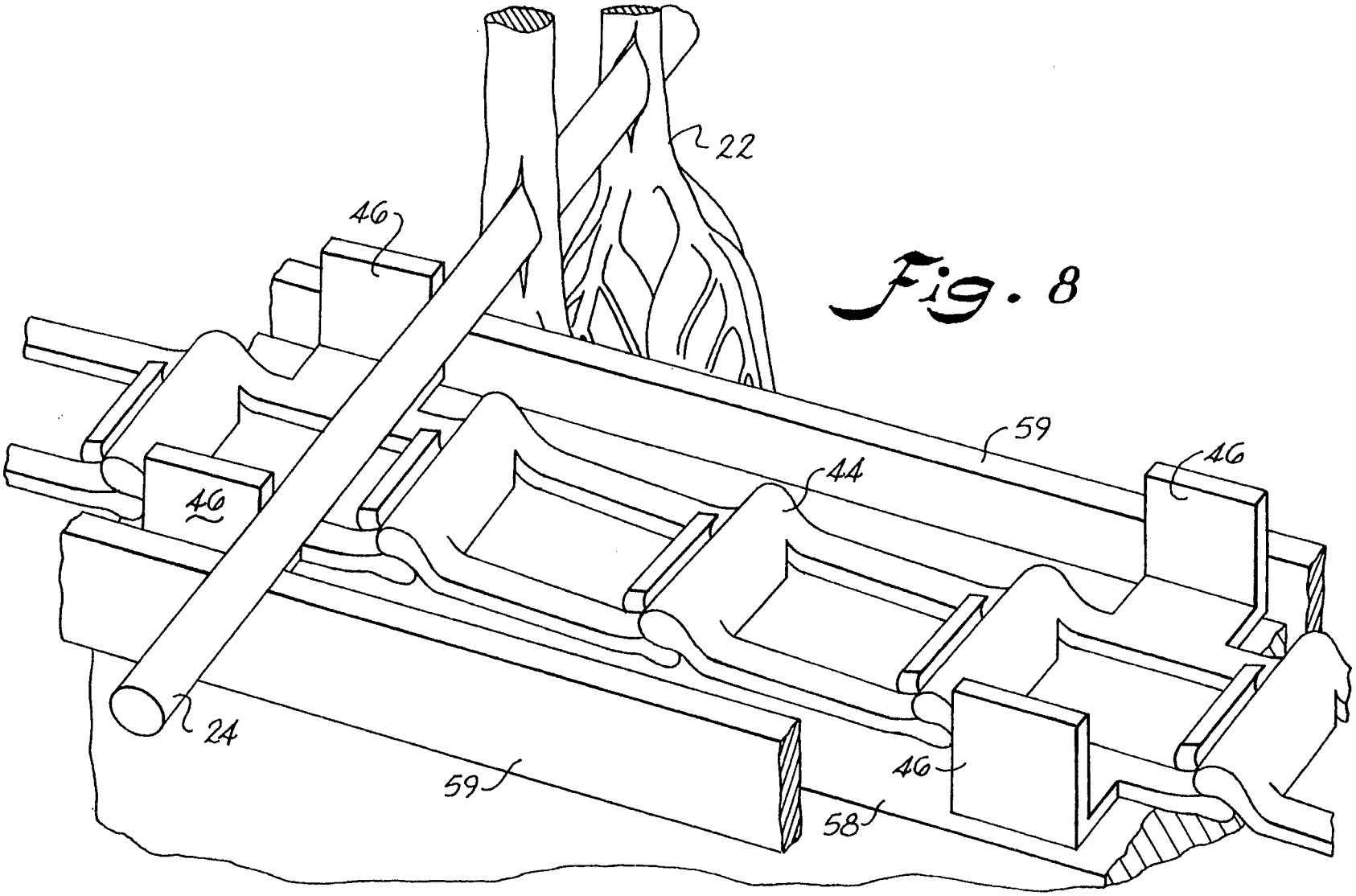
FIG. 8 is an enlarged perspective illustration of the tobacco rod support members and continuous conveying member, particularly a mill chain and the positioning means or attachments therealong.

A continuous conveying member 42 is also provided as a component of variable conveying means B. Continuous conveying member 42 cooperates with support members 34 so that the bulk or load of tobacco rods 24 are conveyed generally along support members 34 along the length of casing bay 28. Positioning means D are also included with conveying member 42 for positioning tobacco rods 24 along support members 34 and maintaining a predetermined distance between rods 24 as they are conveyed through casing bay 28. In a preferred embodiment of the invention, conveying member 42 comprises a conventional mill chain 44 and positioning means D comprises conventional attachments 46 fitted upon mill chain 44. The operation and configuration of conventional mill chains with appropriate attachments is commonly understood. The relation between mill chain 44 and attachments 46 is particularly illustrated in FIG. 8.

In the embodiment of FIG. 5, mill chain 44 is guided along support members 34 through a recess formed on the top thereof with side members 59. Side members 59 may comprise, for example, a length of wood attached to each side of support members 34, as particularly shown in FIG. 8. In an alternative embodiment, a recess or centering groove may be otherwise formed in support member 34. Any suitable means for guiding mill chain 44 along support member 34 may be utilized. It should also be understood that it is not necessary to drive both sides of the chain drive apparatus 38 as illustrated in FIG. 5.

Figure 9:
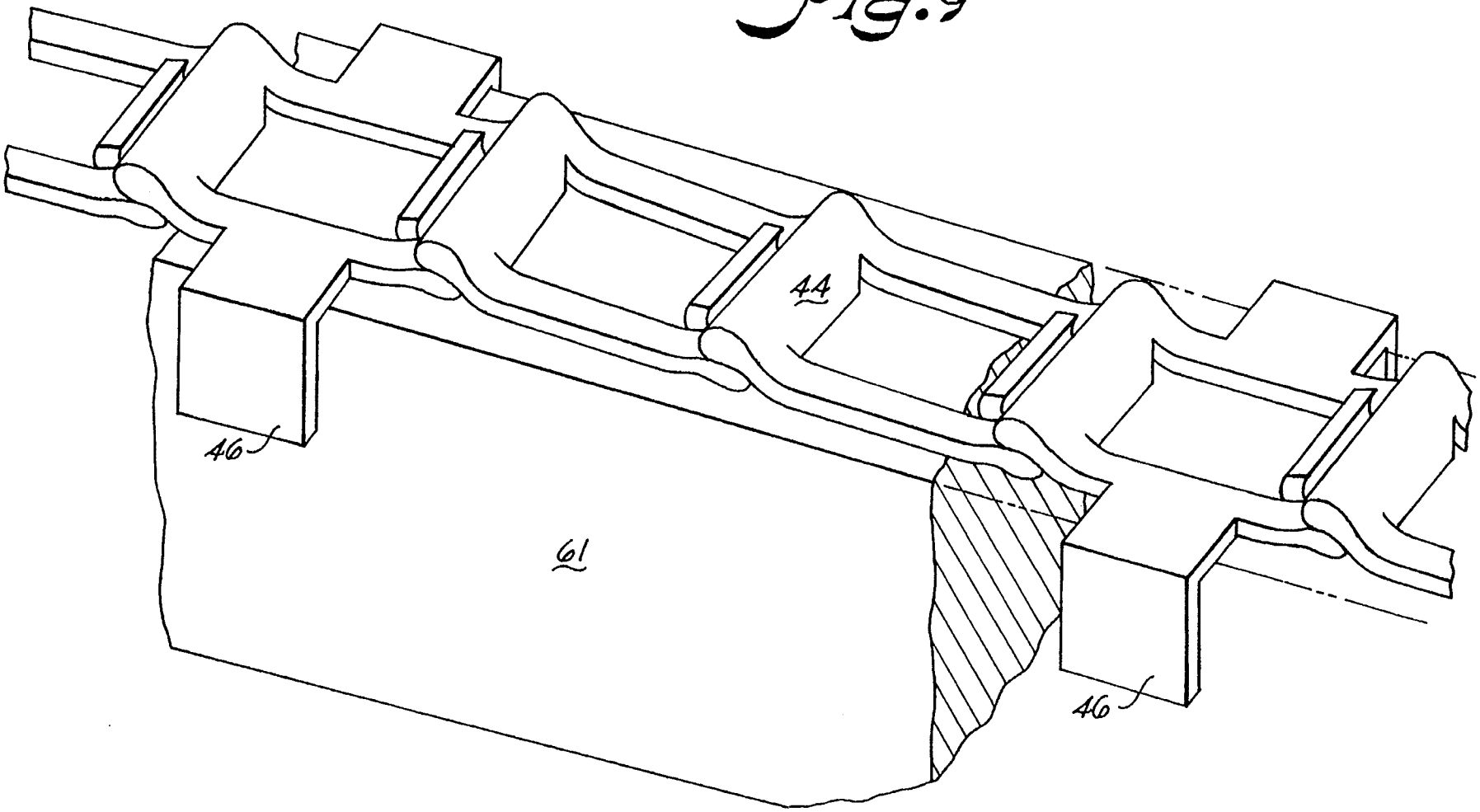
FIG. 9 is another enlarged perspective illustration of the continuous conveying member and the return beam illustrated in FIG. 5.

In a preferred embodiment of the chain drive apparatus illustrated in FIG. 5, return beams 61 are provided for guiding continuous conveying member 42 in the continuous conveying loop. Return beams 61 may preferably comprise a simple piece of wood or like structure preferably having a width less than that of attachments 46. In this way, attachments 46 fit along each side of return beams 61 thereby positively guiding mill chain 44 as shown particularly in FIG. 9.

The arrangement of FIG. 5 is but an example of an acceptable chain drive apparatus 38 which may be employed as variable conveying means B. It should be understood that any suitable conveying system may be utilized in this regard. For example, it is not particularly necessary that continuous conveying member 42 comprise a mill chain 44 with attachments 46. Conveying member 42 may comprise a continuous belt with an anti-friction surface, for example. The particular arrangement of driven sprocket 40 and idle sprockets 39 illustrated is also not a limitation to the invention. Any suitable arrangement of such sprockets may be utilized. Also, when a plurality of casing bays 28 are defined within structure 26, variable speed driving means C, particularly motor 41, may be utilized to drive the driving means C for each casing bay 28, or each such casing bay may have its own respective variable speed driving means.

Means C for driving conveying means B are variable so that the rate of conveyance of the tobacco through the casing bay 28 may be appropriately adjusted as a function of the relative humidity within greenhouse structure 26. As the relative humidity within the structure decreases, the rate of conveyance of tobacco therethrough must be accordingly reduced so that the tobacco can be brought in case before reaching the end of casing bay 28. It is also within the scope of the present invention to arrange the conveying means B in such a manner so that the tobacco is conveyed in multiple passes through greenhouse structure 26. It is preferred, however, to construct system 20 and control the relative humidity within greenhouse 26 so that the tobacco can be properly cased in one conveyance through the greenhouse.

Once the tobacco has been cased within structure 26, tobacco rods 24 are lifted from support members 34 so that the tobacco stalks can be removed from the rods. The tobacco is then ready for further processing for market.

It will be apparent to those skilled in the art that various modifications and variations can be made in the apparatus and method of the present invention without departing from the scope or spirit of the invention. For example, the tobacco rod supporting means may comprise the rigid support members 34 or any other suitable structure for supporting the load of tobacco rods within the greenhouse. Also, the chain drive apparatus 38 according to the invention is but one embodiment of an appropriate variable conveying means B for conveying the tobacco rods through the greenhouse. Thus, it is intended that the present invention cover the modification and variations of this invention provided they come within the scope of the appended claims and their equivalents.

What is claimed:

1. A continuous casing system for bringing tobacco in case, the tobacco being in the form of air dried cut tobacco stalks hung from tobacco rods, said system comprising:

a greenhouse structure;

at least one casing bay defined within said greenhouse structure, said casing bay defined by at least two rows of generally upright support poles, said rows of support poles being substantially parallel and spaced apart a predetermined distance of generally the length of the tobacco rods;

a tobacco rod support member carried by each said row of support poles, whereby at least two said support members are oppositely facing within each said casing bay, said support members being at a height so that stalk laden tobacco rods can be suspended therefrom across said casing bay with adequate ground clearance for the tobacco stalks;

means for maintaining a predetermined relative humidity within said greenhouse structure;

conveyance means for conveying tobacco ladden tobacco rods along said tobacco rod support members through said casing bay at a predetermined controlled rate; and whereby the tobacco rods with tobacco stalks hanging therefrom can be placed upon said support members at one end of said casing bay and be conveyed therethrough at a predetermined rate so that the tobacco is brought in case before being unloaded at the opposite end of said casing bay.

2. The system as in claim 1, further comprising a plurality of said casing bays defined within said greenhouse structure, so that a plurality of said casing bays can be utilized within a single said greenhouse structure to bring tobacco in case.

3. The system as in claim 1, wherein said greenhouse structure comprises selectably raisable side panels so that the climate conditions within said greenhouse structure can be effected by raising and lowering said side panels.

4. The system as in claim 1, wherein said conveying means comprises a continuous chain drive apparatus, said chain drive apparatus further comprising at least one drive sprocket, variable speed driving means for driving said driven sprocket, at least one continuous conveying member extending along at least one of said support members within said casing bay, and positioning members affixed to said conveying member for maintaining the tobacco rods at predetermined positions along said continuous conveying member.

5. The system as in claim 4, wherein said continuous conveying member comprises a mill chain and said positioning members comprise protruding attachments secured to said mill chain at predetermined intervals therealong.

6. The system as in claim 1, wherein said greenhouse structure is generally portable and comprises interconnectable framework members and relatively flexible sheeting material fitted upon said framework members forming the roof and sides of said greenhouse structure.

7. The system as in claim 6, further comprising means for variably adjusting the height of said sheeting material forming the sides of said greenhouse structure so that at least a portion of the sides of said greenhouse structure can be opened to the outside.

8. The system as in claim 7, wherein said means for variably adjusting the height of said sheeting material is mechanized.

9. The system as in claim 8, further comprising a thermostatic device for automatically controlling said means for variably adjusting the height of said sheeting material for automatically raising and lowering said sides to maintain a desired climate condition within said greenhouse.

10. The system as in claim 1, wherein said means for maintaining a predetermined relative humidity comprises at least one automatic fogger, said fogger automatically actuating at a predetermined relative humidity within said greenhouse.

11. The system as in claim 1, wherein said conveying means is configured to convey the tobacco rods in multiple passes through said casing bay.

12. The system as in claim 1, wherein said conveying means is configured to convey the tobacco rods in one pass through said casing bay at such a rate so that the tobacco is in case by the time it reaches the end of said casing bay opposite from the end at which it was placed upon said support members, the rate of conveyance being a function of the relative humidity within said greenhouse structure.

13. A continuous conveying system for bringing air dried tobacco in case, the tobacco stalks hanging from tobacco rods, said system comprising:

a greenhouse structure;

automatic atmospheric control equipment for maintaining an optimum humidity condition within said greenhouse structure for casing tobacco;

tobacco rod supporting means for supporting tobacco laden tobacco rods within said greenhouse, said supporting means being of a height sufficient for supporting the tobacco rods with a predetermined degree of ground clearance for the tobacco stalks;

automatic conveying means for conveying the tobacco rods along said tobacco rod supporting means generally along the length of said casing bay, whereby the tobacco rods can be placed upon said supporting means at one end of said greenhouse structure, the tobacco brought in case while being conveyed through said greenhouse structure, and the tobacco rods lifted from said supporting means at the opposite end of said greenhouse structure; and a transportable elevating scaffold trailer, said tobacco rod supporting means defining at least one casing bay within said greenhouse structure having a width sufficient for said elevating scaffold trailer to be conveyed therethrough, whereby tobacco laden tobacco rods carried by the scaffold trailer can be transferred to said tobacco rod supporting means at one end of said casing bay by lowering said scaffold trailer below and between said tobacco rod supporting means.

14. A method for continuously casing tobacco, the tobacco having been previously hung from tobacco rods and cured, said method comprising the steps of:

at one end of a greenhouse structure, placing the tobacco laden tobacco rods across support members erected within the greenhouse;

maintaining an optimum climatic condition for casing tobacco within the greenhouse structure with automatic atmospheric control equipment;

determining a rate for conveying the tobacco through the greenhouse structure so that the tobacco is in case by the time it reaches the opposite end of the greenhouse structure, the rate being a function of the climatic conditions maintained within the greenhouse structure;

continuously conveying the tobacco laden tobacco rods through the greenhouse structure at the determined rate and retrieving the tobacco rods at the opposite end of the greenhouse structure with the tobacco being in case; and placing the tobacco rods upon an elevating scaffold trailer, transporting the trailer into the greenhouse structure at one end thereof between the support members, lowering the trailer to a height below the support members so that the tobacco rods are transferred to the support members.

* * * * *